US006186610B1

(12) United States Patent
Kocher et al.

(10) Patent No.: US 6,186,610 B1
(45) Date of Patent: Feb. 13, 2001

(54) IMAGING APPARATUS CAPABLE OF SUPPRESSING INADVERTENT EJECTION OF A SATELLITE INK DROPLET THEREFROM AND METHOD OF ASSEMBLING SAME

(75) Inventors: Thomas E. Kocher; Christopher N. Delametter, both of Rochester; Anthony R. Lubinsky, Penfield; Omid A. Moghadam, Pittsford, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/157,455

(22) Filed: Sep. 21, 1998

(51) Int. Cl.[7] ..... B41J 29/38

(52) U.S. Cl. ..... 347/11; 347/14; 347/19; 347/68

(58) Field of Search ..... 347/9–11, 15, 347/68–71, 14, 19

(56) References Cited

U.S. PATENT DOCUMENTS

| | | | |
|---|---|---|---|
| 4,695,852 | 9/1987 | Scardovi | 347/14 |
| 4,743,924 | 5/1988 | Scardovi | 347/10 |
| 4,752,790 | 6/1988 | Scardovi | 347/10 |
| 5,757,392 | 5/1998 | Zhang | 347/14 |

OTHER PUBLICATIONS

Omid A. Moghadam et al, An Imaging Apparatus Capable of Inhibiting Inadvertent Ejection of a Satellite Ink Droplet Therefrom and Method of Assembling Same, USSN 09/083,679, filed May 22, 1998.

Xin Wen, "Printer Apparatus Capable of Varying Direction Of An Ink Droplet To Be Ejected Therefrom And Method Therefor", USSN 09/036,012, filed Mar. 6, 1998.

Oosterbroek et al., "Designing, realization and characterization of a novel capacitive pressure/flow sensor", Jun. 16, 1997, pp. 151–154.

*Primary Examiner*—John Barlow
*Assistant Examiner*—Craig A. Hallacher
(74) *Attorney, Agent, or Firm*—Walter S. Stevens

(57) ABSTRACT

An imaging apparatus capable of suppressing inadvertent ejection of a satellite ink droplet and method of assembling the apparatus. The imaging apparatus comprises a print head transducer including a pair of sidewalls defining a chamber therebetween, the channel having an ink body disposed therein. The transducer is capable of inducing a first pressure wave in the ink body in order to eject an intended ink droplet. A waveform generator is connected to the transducer for supplying a voltage waveform to the transducer, so that the transducer induces pressure waves in the ink body to eject the ink droplet. However, the first pressure wave has a reflected portion formed by the first pressure wave reflecting from the sidewalls. The reflected portion is sufficient to inadvertently eject unintended satellite ink droplets following ejection of the intended ink droplet. To avoid formation of satellite ink droplets, a sensor is in fluid communication with the ink body for sensing the reflected portion. A feedback circuit interconnects the transducer and the sensor for inducing a second pressure wave in the ink body in response to the reflected portion sensed by the sensor. The second pressure wave has an amplitude and phase damping the reflected portion of the first pressure wave in order to the suppress inadvertent ejection of the satellite ink droplets.

41 Claims, 14 Drawing Sheets

320
325
260
176
25
175
174

30
285
25
SEE FIG. 1A
140
150
100
10
135
110
TRANSPORT CONTROL SYSTEM
TRANSPORT MECHANISM
AMPLIFIER
85
345
130
120
90
INK PRESSURE REGULATOR
CONTROLLER
PULSE GENERATOR
80
370
SWITCH
340
FEED BACK CIRCUIT

40
IMAGE SOURCE
IMAGE PROCESSOR
DIGITAL HALFTONING UNIT
IMAGE MEMORY
50
60
70
365

IMAGING APPARATUS CAPABLE OF SUPPRESSING INADVERTENT EJECTION OF A SATELLITE INK DROPLET THEREFROM AND METHOD OF ASSEMBLING SAME

BACKGROUND OF THE INVENTION

The present invention relates to imaging apparatus and methods and more particularly relates to an imaging apparatus capable of suppressing inadvertent ejection of a satellite ink droplet therefrom and method of assembling same.

An imaging apparatus, such as an ink jet printer, produces images on a receiver medium by ejecting ink droplets onto the receiver medium in an image-wise fashion. The advantages of non-impact, low-noise, low energy use, and low cost operation in addition to the ability of the printer to print on plain paper are largely responsible for the wide acceptance of ink jet printers in the marketplace.

One such ink jet printer is disclosed in commonly assigned U.S. patent application Ser. No. 09/036,012, titled "Printer Apparatus Capable Of Varying Direction Of An Ink Droplet To Be Ejected Therefrom And Method Therefor" filed Mar. 6, 1998 in the name of Xin Wen. The ink jet printer of the Wen disclosure includes a piezoelectric print head capable of varying direction of an ink droplet to be ejected from the print head. A pair of sidewalls belonging to the print head define an ink channel therebetween containing ink. The print head includes addressable electrodes attached to the side walls for actuating (i.e., moving) the sidewalls, so that the ink droplet is ejected from the ink channel. In this regard, a pulse generator applies time and amplitude varying electrical pulses to the addressable electrodes for actuating the sidewalls.

More specifically, when the side walls of the Wen device inwardly move due to the actuation thereof, a pressure wave is established in the ink contained in the channel. As intended, this pressure wave squeezes a portion of the ink in the form of the ink droplet out the channel. However, as the pressure wave ejects the ink droplet, the pressure wave impacts the sidewalls defining the channel and is reflected therefrom. The pressure wave reflected from the sidewalls establishes a reflected pressure wave in the channel, this reflected pressure wave being defined herein as a "reflected portion" of the incident pressure wave. Of course, if the time between actuations of the sidewalls is sufficiently long, the reflected portion dies-out before each successive actuation of the sidewalls.

However, the reflected portion of the pressure wave may be of amplitude sufficient to inadvertently eject an unintended so-called "satellite droplet" that follows ejection of the intended ink droplet but that occurs before the reflected portion dies-out. Satellite ink droplet formation is undesirable because such inadvertent satellite ink droplet formation interferes with precise ejection of ink droplets from the ink channels, which leads to ink droplet placement errors. These ink droplet placement errors in turn produce image artifacts such as banding, reduced image sharpness, extraneous ink spots, ink coalescence and color bleeding. Thus, a problem in the art is satellite ink droplet formation leading to ink droplet placement errors.

In addition, as stated hereinabove, if the time between actuations of the sidewalls is sufficiently long, the reflected portion of the pressure wave eventually dies-out. Thus, printer speed is selected such that electrical pulses are applied to the addressable electrodes at intervals after each reflected portion dies-out. Such delayed printer operation is required in order to avoid the unintended reflected portion interfering with the intended pressure wave. Otherwise allowing the reflected portion to interfere with the intended pressure wave may result in the aforementioned ink droplet placement errors. However, operating the printer in this manner reduces printing speed because ejection of ink droplets must await the cessation of the reflected portion of the pressure wave. Therefore, quite apart from the aforementioned problem of satellite droplet formation, another problem in the art is reduced printer speed due to presence of the reflected portion of the intended pressure wave.

Therefore, there has been a long-felt need to provide an imaging apparatus capable of suppressing inadvertent ejection of a satellite ink droplet therefrom while maintaining printing speed, and method of assembling the apparatus.

SUMMARY OF THE INVENTION

An object of the present invention is to provide an imaging apparatus capable of suppressing inadvertent ejection of a satellite ink droplet therefrom while maintaining printing speed, and method of assembling the apparatus.

With this object in view, the invention resides in an imaging apparatus, comprising a transducer defining a chamber therein, said transducer capable of inducing a first pressure wave in the chamber, the first pressure wave having a reflected portion; and a deflectable sensor coupled to the chamber for sensing the reflected portion and connected to said transducer for actuating said transducer in response to the reflected portion sensed thereby, so that said transducer actuates to induce a second pressure wave in the chamber damping the reflected portion, said sensor capable of deflecting as said sensor senses the reflected portion.

According to one embodiment of the present invention, an imaging apparatus, with pressure sensor, is provided that is capable of suppressing inadvertent ejection of a satellite ink droplet from an ink body residing in the imaging apparatus. The imaging apparatus comprises a print head defining a chamber having the ink body disposed therein. A transducer (e.g., a piezoelectric transducer) is in fluid communication with the ink body for inducing a first pressure wave in the ink body, which first pressure wave has a reflected portion of a first amplitude and a first phase sufficient to inadvertently eject satellite droplets. In this regard, a waveform generator is connected to the transducer for supplying a first voltage waveform to the transducer, so that the transducer induces the first pressure wave in the ink body. In addition, a sensor is in fluid communication with the ink body for sensing the reflected portion of the first pressure wave and for generating a second voltage waveform in response to the reflected portion sensed by the sensor. Moreover, a feedback circuit is connected to the sensor for receiving the second voltage waveform generated by the sensor. The feedback circuit converts the second voltage waveform to a third voltage waveform. The amplitude and phase of the third voltage waveform are chosen by the feedback circuit to rapidly drive the reflected portion and thus the second voltage waveform to zero. The third voltage waveform is transmitted to the transducer, so that the transducer controllably actuates in response to the third voltage waveform supplied thereto. This third voltage waveform induces a second pressure wave in the ink body. The second pressure wave has a second amplitude and a second phase which damps the amplitude of the reflected portion of the first pressure wave in order to suppress inadvertent ejection of satellite ink droplets. This is so because the amplitude and phase of the third voltage waveform are chosen by the feedback circuit to rapidly drive the reflected portion and thus the second voltage waveform to zero, as previously mentioned.

The imaging apparatus further comprises a switch capable of switching between a first operating mode and a second operating mode. When the switch switches to the first operating mode, the switch connects the waveform generator to the transducer for actuating the transducer in order to produce the first pressure wave in the chamber. When the switch switches to the second operating mode, the switch connects the feedback circuit to the sensor and transducer for sensing the reflected portion of the first pressure wave and for damping the reflected portion in the manner mentioned hereinabove.

A feature of the present invention is the provision of a sensor coupled to the chamber for sensing the reflected portion of the first pressure wave.

Another feature of the present invention is the provision of a feedback circuit connected to the sensor for controllably applying the second pressure wave to the ink body, such that the second pressure wave damps the reflected portion of the first pressure wave.

An advantage of the present invention is that satellite ink droplet formation is inhibited.

Another advantage of the present invention is that printing speed is maintained as satelite ink droplet formation is inhibited.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figures 1, 1A:
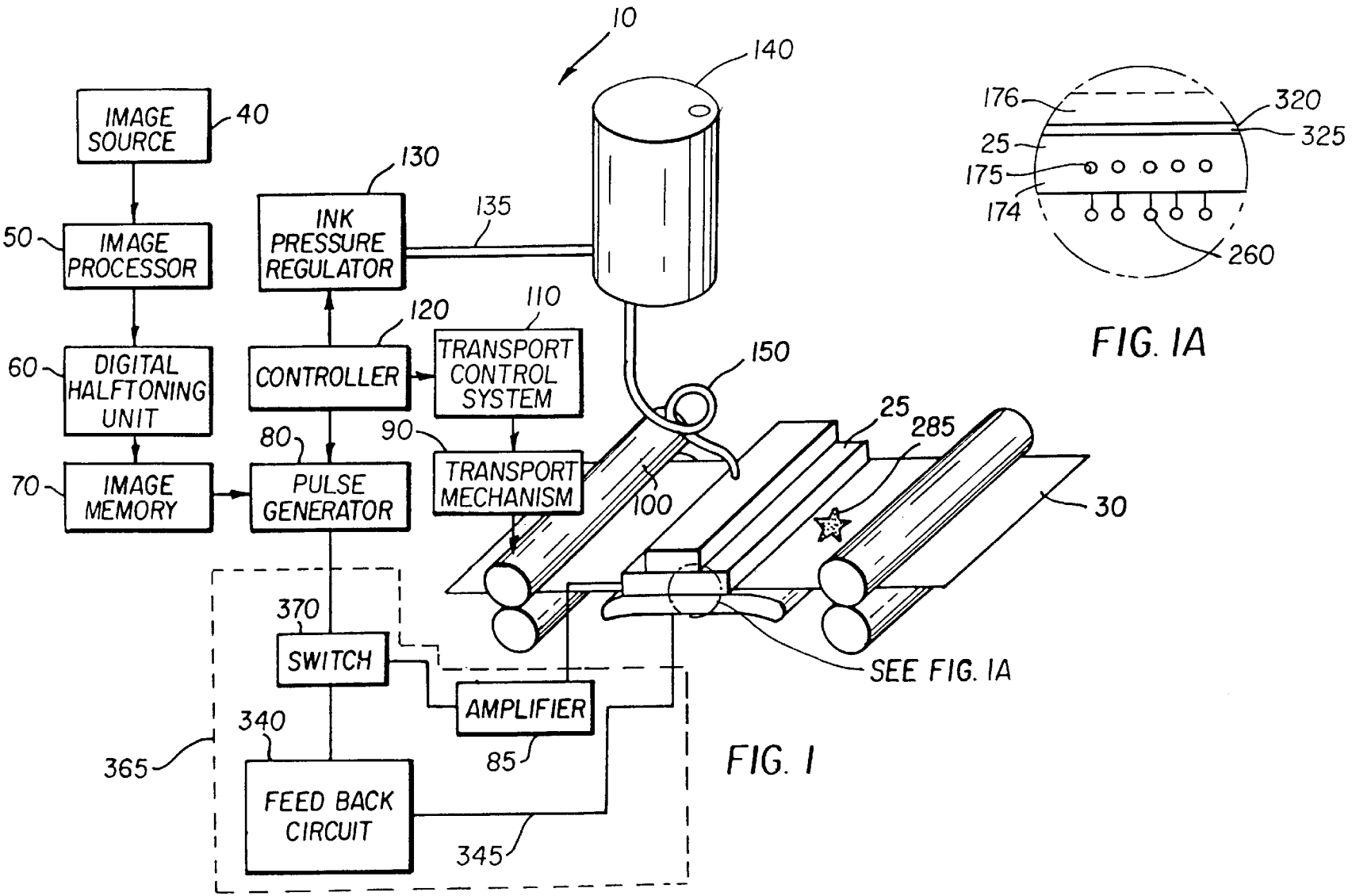
FIG. 1 shows an imaging apparatus comprising a print head.
FIG. 1A is a fragmentation view in elevation of the print head.

Therefore, referring to FIGS. 1 and 1A, there is shown the subject matter of the present invention, which is an imaging apparatus, generally referred to as 10, for ejecting an ink droplet 20 from a print head 25 toward a receiver 30. In this regard, receiver 30 may be a reflective-type (e.g., paper) or transmissive-type (e.g., transparency) receiver. Although apparatus 10 is capable of ejecting droplet 20, apparatus 10 is also capable of inhibiting inadvertent ejection of a so-called "satellite ink droplet" 22, as described in detail hereinbelow.

As shown in FIG. 1, imaging apparatus 10, which is preferably an ink jet printer, comprises an image source 40, which may be raster image data from a scanner or computer, or outline image data in the form of a PDL (Page Description Language) or other form of digital image representation. This image data is transmitted to an image processor 50 connected to image source 40. Image processor 50 converts the image data to a pixel-mapped page image. Image processor 50 may be a raster image processor in the case of PDL image data to be converted, or a pixel image processor in the case of raster image data to be converted. In any case, image processor 50 transmits continuous tone data to a digital halftoning unit 60 connected to image processor 50. Halftoning unit 60 halftones the continuous tone data produced by image processor 50 and produces halftoned bitmap image data that is stored in an image memory 70, which may be a full-page memory or a band memory depending on the configuration of imaging apparatus 10. A waveform generator 80 connected to image memory 70 reads data from image memory 70 and applies time and amplitude varying electrical stimuli, through an amplifier 85, to an electrical actuator (i.e., an electrode), as described more fully hereinbelow.

Figure 2:
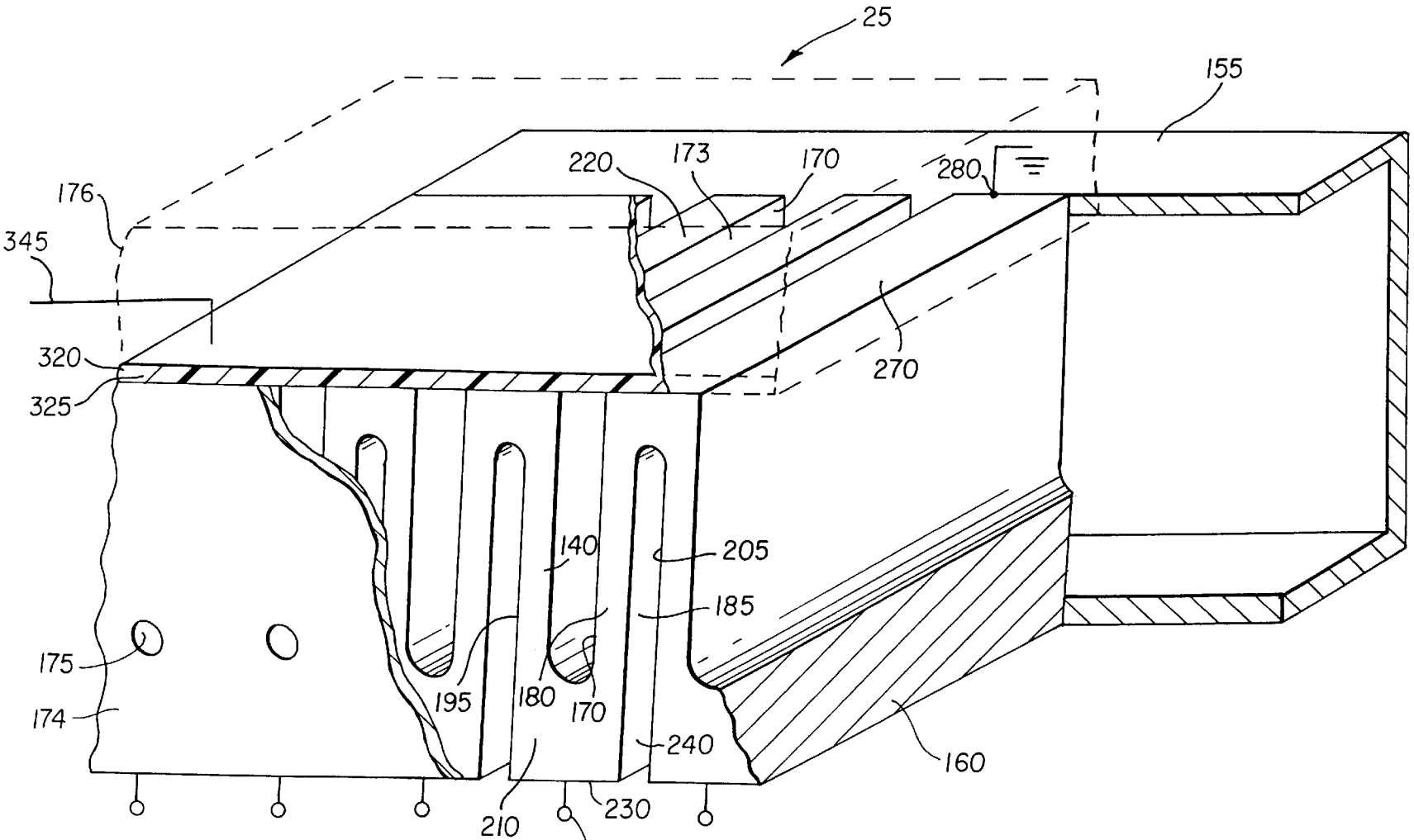
FIG. 2 is a fragmentation view in perspective of the print head, this view showing a front side of the print head and also showing a first embodiment pressure sensor in communication with ink chambers formed in the print head.
Figure 3:
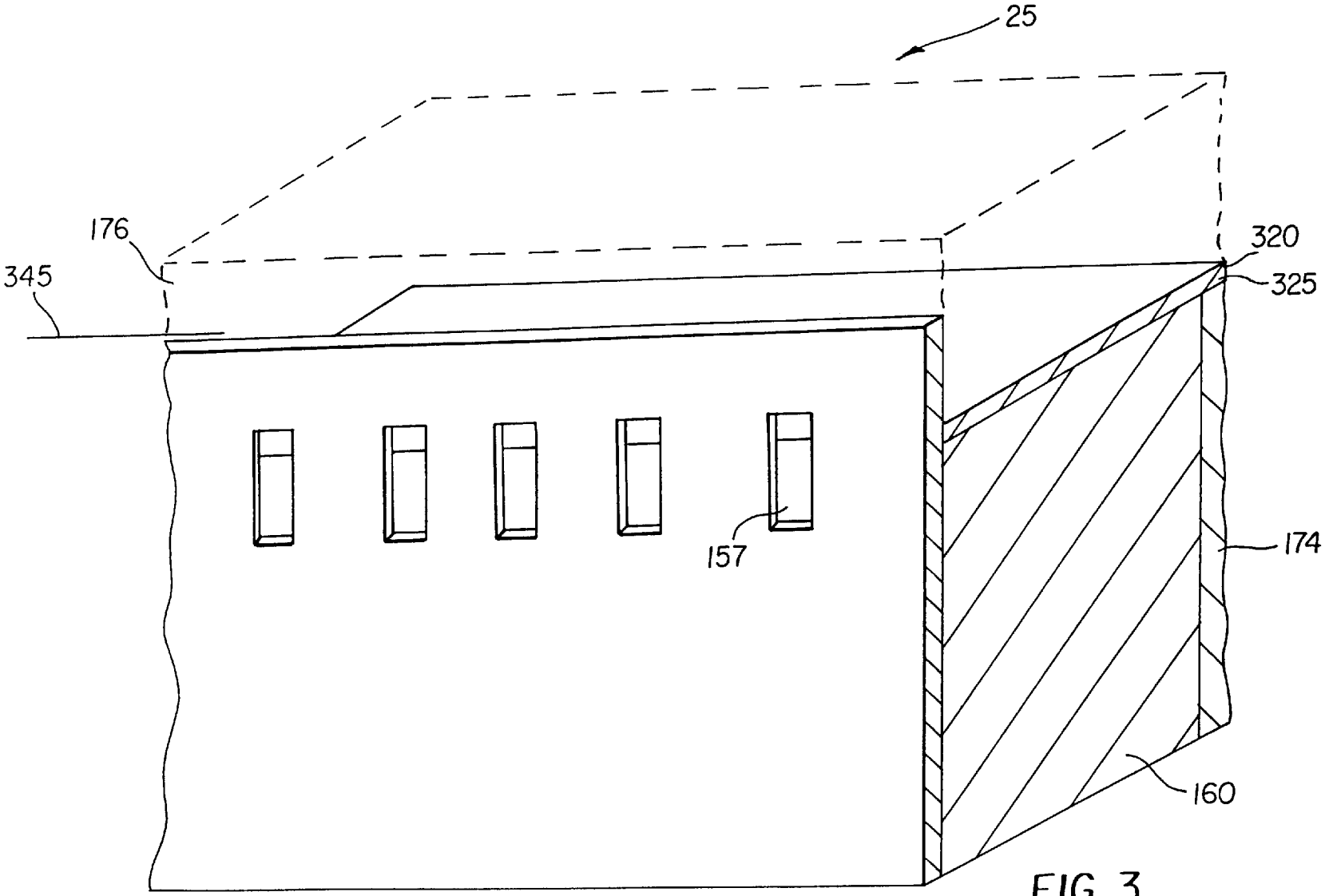
FIG. 3 is a fragmentation view in perspective of the print head, this view showing a rear side of the print head with an attached manifold.
Figure 4:
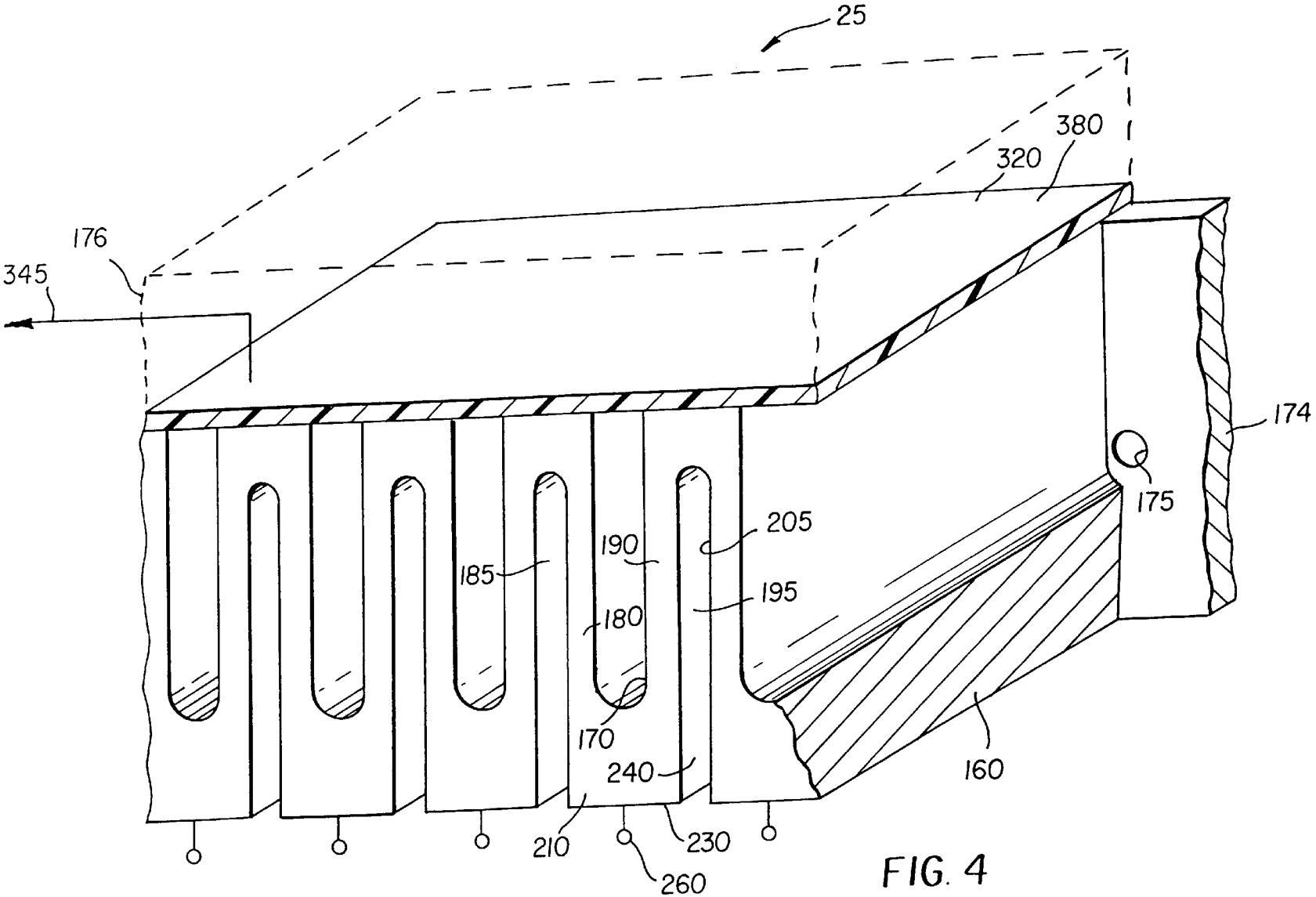
FIG. 4 is a fragmentation view in perspective of the print head, the view showing the rear side of the print head without the attached manifold.
Figure 5:
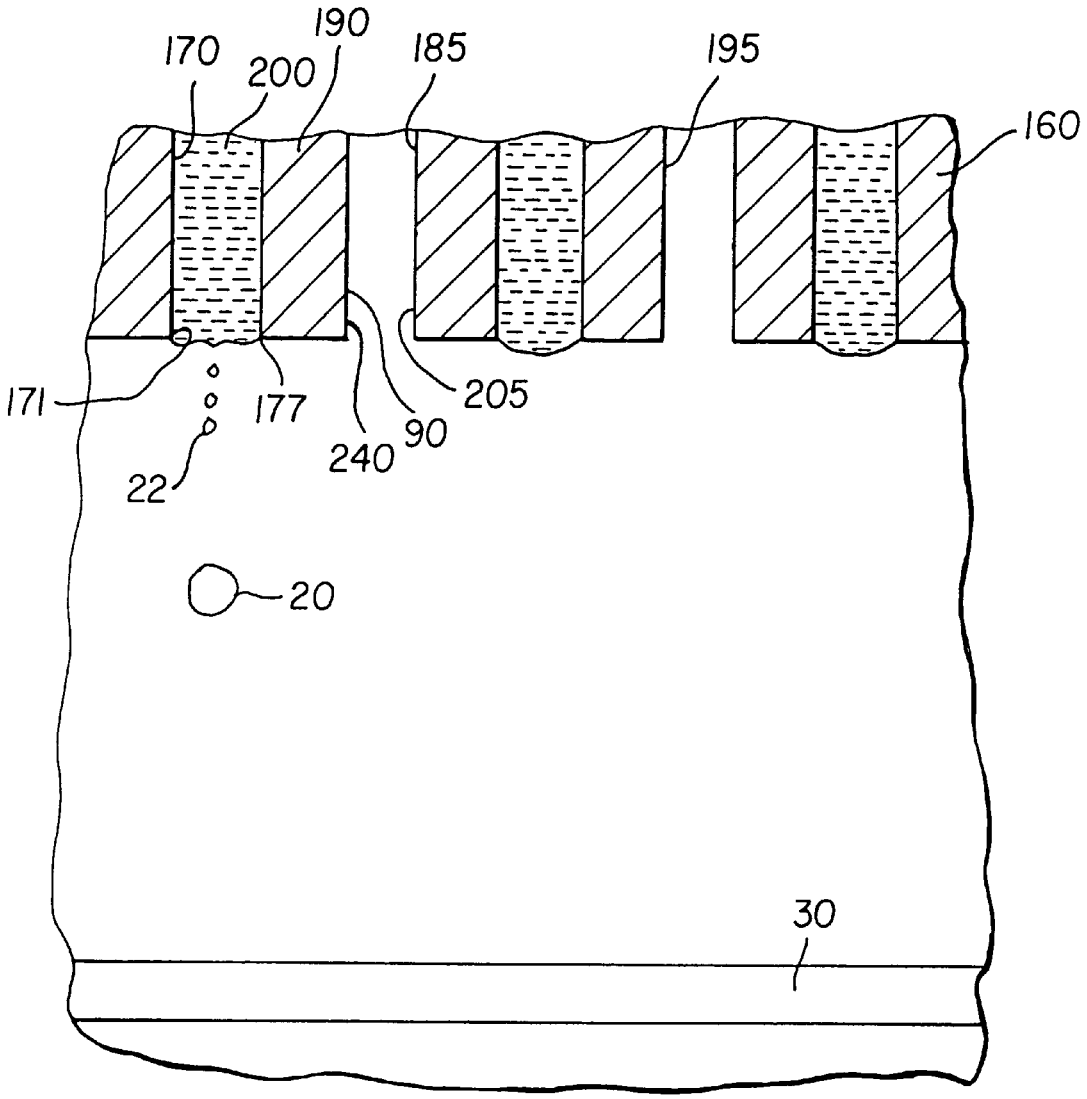
FIG. 5 is a fragmentation view in horizontal section of the print head.

Referring to FIGS. 1, 2 and 3, receiver 30 is moved relative to print head 25 by means of a transport mechanism 90, such as rollers 100, which are electronically controlled by a transport control system 10. Transport control system 110 in turn is controlled by a suitable controller 120. It may be appreciated that various mechanical configurations for transport control system 110 are possible. For example, in the case of pagewidth print heads, it is convenient to move receiver 30 past a stationary print head 25. On the other hand, in the case of scanning-type printing systems, it is more convenient to move print head 25 along one axis (i.e., a sub-scanning direction) and receiver 30 along an orthogonal axis (i.e., a main scanning direction), in a relative raster motion. In addition, if desired, controller 120 may be connected to an ink pressure regulator 130 for controlling regulator 130. Regulator 130, if present, is capable of regulating pressure in an ink reservoir 140. Ink reservoir 140 is connected, such as by means of a conduit 150, to print head 25 for supplying liquid ink to print head 25. In this regard, ink is preferably distributed to a back surface of print head 25 by a manifold 155 belonging to print head 25. Manifold 155 includes a plurality of openings 157 for reasons disclosed hereinbelow.

Referring to FIGS. 1A, 2, 3 and 4, print head 25 comprises a generally cuboid-shaped preferably one-piece transducer 160 formed of a piezoelectric material, such as lead zirconate titanate (PZT), which is responsive to electrical stimuli. Cut into transducer 160 are a plurality of elongate ink chambers 170 capable of accepting ink supplied thereinto from manifold 155 through the previously mentioned orifices 157. Each opening 157 is aligned with its respective channel 170. Each of the chambers 170 has a chamber outlet 171 at an end 177 thereof and an open side 173 extending the length of chamber 170. Ink chambers 170 are covered at outlets 171 by a nozzle plate 174 having a plurality of colinearly aligned orifices 175 that are themselves aligned with respective ones of chamber outlets 171, so that ink droplets 20 are ejected from chamber outlets 171 and through their respective orifices 175 and thereafter along a trajectory normal to nozzle plate 174. Nozzle plate 174, itself, is attached to a front side of transducer 160. Ink manifold 155, which is attached to a rear side of transducer 160, has ink therein for supplying the ink to chambers 175. In addition, a top cover plate, shown in phantom, caps chambers 170 along open side 173. During operation of apparatus 10, ink from reservoir 140 is controllably supplied to manifold 155 by means of conduit 150 and thence to each chamber 175.

As best seen in FIG. 2, transducer 160 includes a first side wall 180 and a second side wall 190 defining chamber 170 therebetween, which chamber 170 is adapted to receive an ink body 200 therein. Moreover, cut into transducer 160 between adjacent chambers 170 and extending parallel thereto may be a cutout 205 separating chambers 170 for reducing mechanical and hydraulic coupling (i.e., "cross-talk") between chambers 170. Each first side wall 180 has an outside surface 185 facing cut-out 205 and each second side wall 190 has an outside surface 195 also facing cut-out 205. Transducer 160 also includes a base portion 210 interconnecting first side wall 180 and second side wall 190, so as to form a generally U-shaped structure of the piezoelectric material. Upper-most surfaces (as shown) of first wall 180 and second wall 190 together define a top surface 220 of transducer 160. Base portion 210 defines a bottom surface 230 of transducer 160 (as shown). In addition, an addressable electrode actuator layer 240 is deposited on sidewalls 180/190. In this configuration of addressable electrode layer 240, an electrical field (not shown) is established in a predetermined orientation to actuate sidewalls 180/190. Moreover, addressable electrode layer 240 is connected to the previously mentioned waveform generator 80 via amplifier 85. In this regard, waveform generator 80 supplies amplified electrical stimuli to each of the portions of addressable electrode layer 240 via an electrical conducting terminal 260.

Referring yet again to FIG. 2, a common electrode layer 270 coats each chamber 170 and also extends therefrom along top surface 220. Common electrode layer 270 is preferably connected to a ground electric potential, as at a point 280. When waveform generator 80 supplies electrical stimuli to addressable electrode actuator layer 240, the previously mentioned electric field (not shown) is established between addressable electrode actuator layer 240 and common electrode layer 270. This electric field in piezoelectric sidewalls 180/190 deforms and inwardly moves sidewalls 180/190. As sidewalls 180/190 deform, ink droplet 20 is ejected from chamber 170 in order to form an image 285 (see FIG. 1) on receiver 30.

Figure 6:
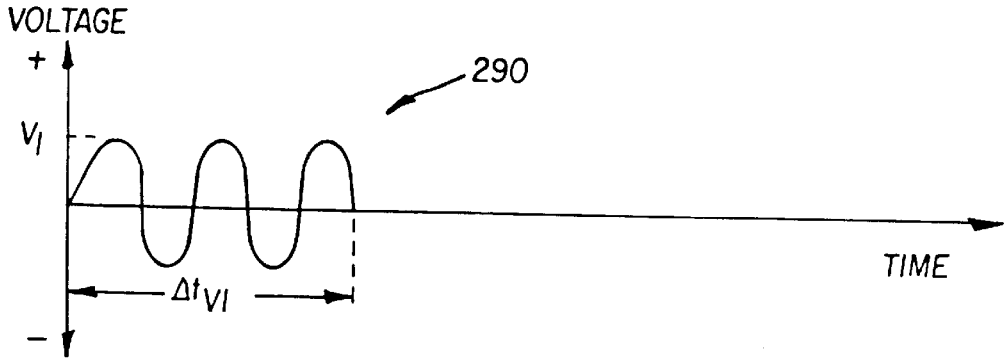
FIG. 6 shows a graph of a first voltage waveform applied to the print head.
Figure 7:
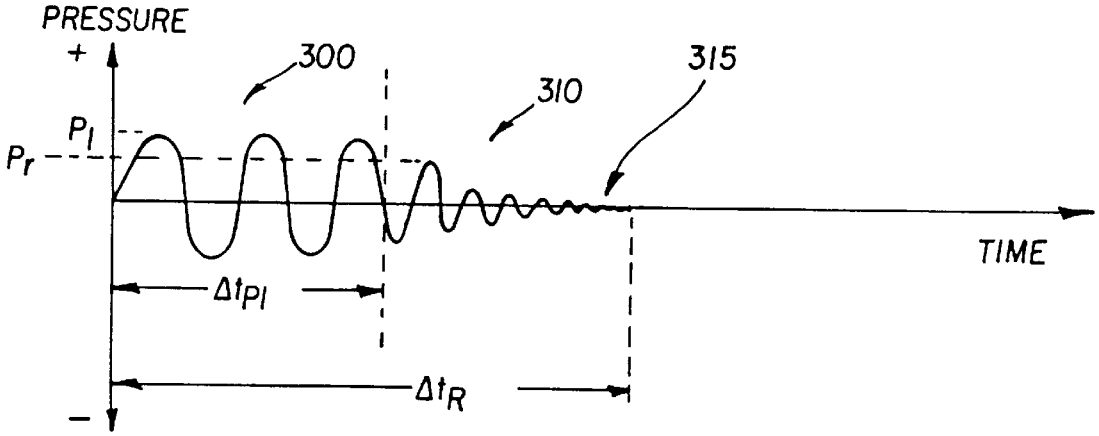
FIG. 7 shows a graph of a first pressure wave produced by the first voltage waveform, the first pressure wave having a reflected portion.
Figure 8:
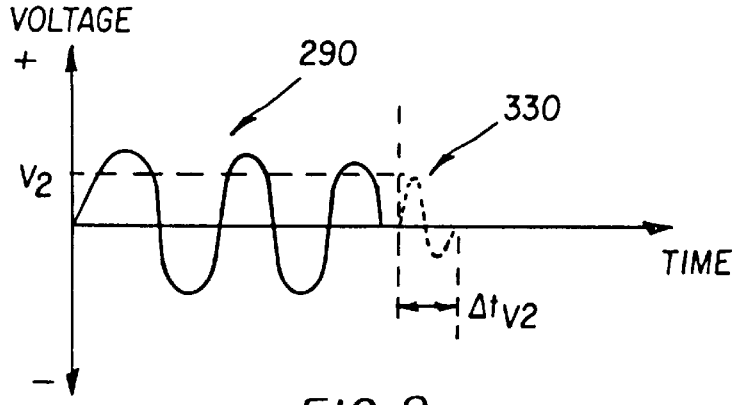
FIG. 8 shows a graph including a second voltage waveform produced in response to a sensor sensing the reflected portion of the first pressure wave.
Figure 9:
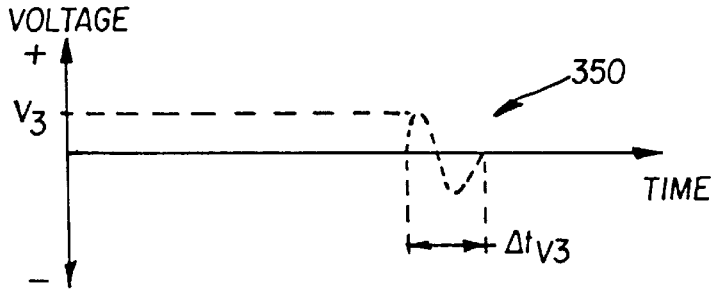
FIG. 9 shows a graph of a third voltage waveform applied to the print head.
Figure 10:
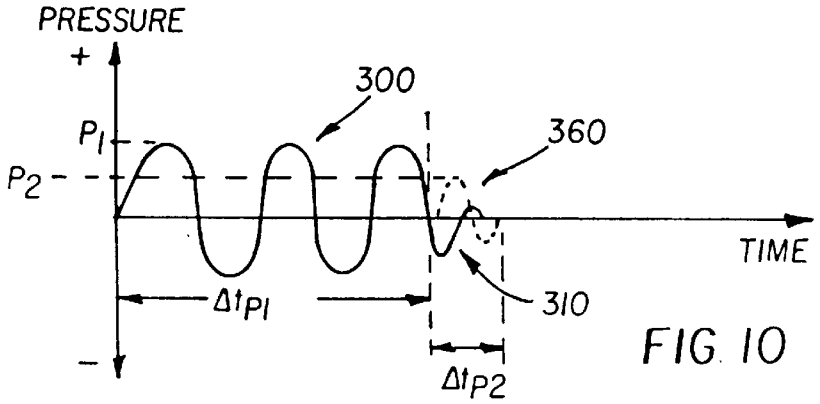
FIG. 10 shows a graph including a second pressure wave produced by the third voltage waveform for damping the reflected portion of the first pressure wave.

Turning now to FIGS. 6 and 7, there is shown a first electrical waveform, generally referred to as 290, for inducing a first pressure wave, generally referred to as 300, in ink body 200. First pressure wave 300, which may be oscillating in nature (as shown), is induced in ink body 200 in order to squeeze ink droplet 20 from ink body 200 and thereby eject ink droplet 20 from chamber 170. In this regard, waveform generator 80 supplies first voltage waveform 290 through amplifier 85 to addressable electrode layer 240, via terminal 260, in order to electrically stimulate pair of sidewalls 180/190. Sidewalls 180/190 deform as sidewalls 180/190 are electrically stimulated. First electrical waveform 290 has a voltage amplitude $V_1$ and a time duration $\Delta t_{v1}$. As stated hereinabove, when sidewalls 180/190 deform, first pressure wave 300 is induced in ink body 200. This first pressure wave 300 has a first amplitude $P_1$ and a first time duration $\Delta t_{P1}$. However, first pressure wave 300 is reflected from sidewalls 180/190 and from nozzle plate 174 and gasket 158. Unless suppressed, first pressure wave 300 forms an undesirable reflected portion 310 of first pressure wave 300. Reflected portion 310 may be oscillating in nature (as shown). When present, reflected portion 310 will have a maximum pressure amplitude $P_r$ lower than amplitude $P_1$, to be followed by successively lower amplitudes until reflected portion 310 dies-out, as generally shown at point 315. However, reflected portion 310 of first pressure wave 310 may have amplitudes sufficient to inadvertently eject so-called "satellite" droplet 22 following ejection of the intended ink droplet 20. Satellite ink droplet formation is undesirable because such satellite ink droplet formation interferes with precise ejection of ink droplets 20 from ink chambers 170, which in turn leads to ink droplet placement errors. However, if a time duration $\Delta t_R$ between successive actuations of sidewalls 180/190 is sufficiently long, reflected portion 310 of first pressure wave 300 eventually dies-out. Thus, in order that reflected portion 310 not interfere with proper ejection of subsequent "intended" ink droplets 20, the prior art provides that printer speed must be reduced in order that waveform 290 be applied to addressable electrode 240 at intervals after each reflected portion 310 dies-out. However, it is undesirable to reduce printer speed. Therefore, the invention suppresses formation of reflected portion 310 so that printer speed is increased.

Accordingly, referring to FIGS. 2, 3, 4, 8, 9 and 10, a first embodiment pressure sensor 320 is coupled to each chamber 170. First embodiment sensor 320 may be a relatively thin one-piece piezoelectric sensor wafer 325 spanning all chambers 170. In this manner, sensor wafer 325 is in fluid communication with each ink body 200. The purpose of wafer 325 is to sense pressure changes occurring in any chamber 170 by sensing presence of reflected portion 310 of first pressure wave 300. It may be understood from the teachings herein, that reflected portion 310 gives rise to pressure changes in chamber 170. These pressure changes deflect piezoelectric wafer 325. In this regard, it is known that when an electrical signal is applied to a piezoelectric material, mechanical distortion occurs in the piezoelectric material due to formation of an electric field caused by the electrical signal. This inherent phenomenon of piezoelectric materials is relied upon to deform piezoelectric sidewalls 180/190 to eject ink droplet 20. Similarly, it is known that when a piezoelectric material deforms, the deformation of the piezoelectric material gives rise to an electric field and voltage difference across the piezoelectric material. Thus, as wafer 325 senses presence of reflected portion 310, wafer 325 deflects and generates a second voltage waveform, generally referred to as 330, in response to the reflected portion 310 sensed by sensor 325. In this regard, second voltage waveform 330 has an amplitude $V_2$ and a time duration $\Delta t_{V2}$. A suitable wafer 325 usable with the invention may be of a type disclosed in an article titled "Designing, Realization And Characterization Of A Novel Capacative Pressure/Flow Sensor" authored by R. E. Oosterbroek and published in the Proceedings, IEEE Transducers Conference, 1997, pages 151–154.

Referring to FIGS. 1, 2, 3, 4, 6, 7, 8, 9 and 10, a feedback circuit 340 is connected to wafer 325, such as by an electrode 345 deposited thereon, for receiving second voltage waveform 330. Feedback circuit 340 is capable of converting second voltage waveform 330 to a third voltage waveform 350 to be applied through amplifier 85 to addressable electrode layer 240 in order to damp reflected portion 310 of first pressure wave 300. As described in more detail presently, third voltage waveform 350 acts as a transducer drive signal. More specifically, feedback circuit 340 calculates third voltage waveform 350 based on second voltage waveform 330, which is received from wafer 325, as described in detail presently. In this regard, third voltage waveform 350 is generated by feedback circuit 340 so as to have an amplitude $V_3$ and a time duration $\Delta t_{V3}$ to drive the input second voltage waveform 330 to zero, and thus dampen the reflected portion 310 of first pressure wave 300. Feedback circuit 340 is connected to amplifier 85 and transmits this third voltage waveform 350 to transducer 160 via amplifier 85. That is, amplifier 85 receives third voltage waveform 350 transmitted by feedback circuit 340 and supplies the amplified third voltage waveform 350 to addressable electrode actuator layer 240. Addressable electrode layer 240 receives third voltage waveform 350 so as to deform sidewalls 180/190 belonging to transducer 160. Deformation of sidewalls 180/190 thereafter induces a second pressure wave, generally referred to as 360, in ink body 200. Second pressure wave 360 has an amplitude $P_2$ and a time duration $\Delta t_{P2}$. In this manner, second pressure wave 360 has amplitude $P_2$ and a phase (as shown) that effectively damps reflected portion 310, so that satellite droplets 22 are not formed and so that printing speed is increased. Moreover, wafer 325 and feedback circuit 340 are arranged so as to define a feed-back loop 365, for reasons disclosed hereinbelow.

Referring to FIGS. 1, 2, 6, 7, 8, 9 and 10, feedback circuit 340 calculates third voltage waveform 350 based on second voltage waveform 310 that is received from wafer 325, as previously mentioned. The amplified third voltage waveform 350 that is supplied to sidewalls 180/190 damps reflected portion 310. The preferred manner in which feedback circuit 340 performs this calculation will now be described. In this regard, wafer 325 is first calibrated in "open-loop mode". That is, a known voltage $V_3$ is applied through amplifier 85 to transducer 160, which will produce a resulting pressure P in the ink chamber 170, which in turn will cause sensor 320 to produce a voltage $V_{sense}$, the value of which depends on the magnitude of P. This is then repeated for a plurality of applied voltages $V_3$ in order to determine a quantitative relation between $V_3$ and $V_{sense}$, as in Equation (1):

$$V_{sense}=G*V_3 \qquad \text{Equation (1)}$$

where,

G≡Gain of amplifier 85, transducer 160, and sensor 320.

Then, when feedback loop 365 is closed by a switch 370, the third voltage $V_3$, which is supplied to transducer 160 is chosen as:

$$V_3=-(1/G)*V_2 \qquad \text{Equation (2)}$$

The third voltage output signal $V_3$ is chosen in order to cause a second pressure wave 360 in the ink chamber 170 which will exactly cancel the reflected portion 310 that led to the sensor signal $V_2$. $V_3$ will quickly cause the sensor signal to become zero, as the pressure waves in chamber 170 are quickly damped-out. The circuit which implements Equation (2) may easily include an inverter, followed by a multiplier.

It will also be appreciated by those skilled in the art that the calibration relation, Equation (2), between $V_3$ and $V_{sense}$ alternatively may be stored in a look-up table (LUT), as well. The operation of forming the output signal $V_3$ may also be accomplished by digital signal processing circuitry embodied in a micro-controller which is in communication with the above mentioned LUT.

Returning now to FIG. 1, switch 370 is capable of switching between a first operating mode and a second operating mode. In the first operating mode, switch 370 connects waveform generator 80 to amplifier 85 and therefore to transducer 160. Thus, in the first operating mode of switch 370, waveform generator 80 drives amplifier 85 and transducer 160 to eject ink droplet 20. In the second operating mode, which is after transducer 160 ejects droplet 20 and simultaneously with onset of reflected portion 310, switch 370 connects transducer 160 and amplifier 85 to feedback circuit 340, which belongs to feedback loop 365. Consequently, in the second operating mode of switch 370, sensor 320 senses presence of reflected portion 310 of first pressure wave 300. A suitable switch 370 may be a so-called "T-switch" which is available from Siliconix Corporation located in Santa Clara, Calif.

Figure 11:
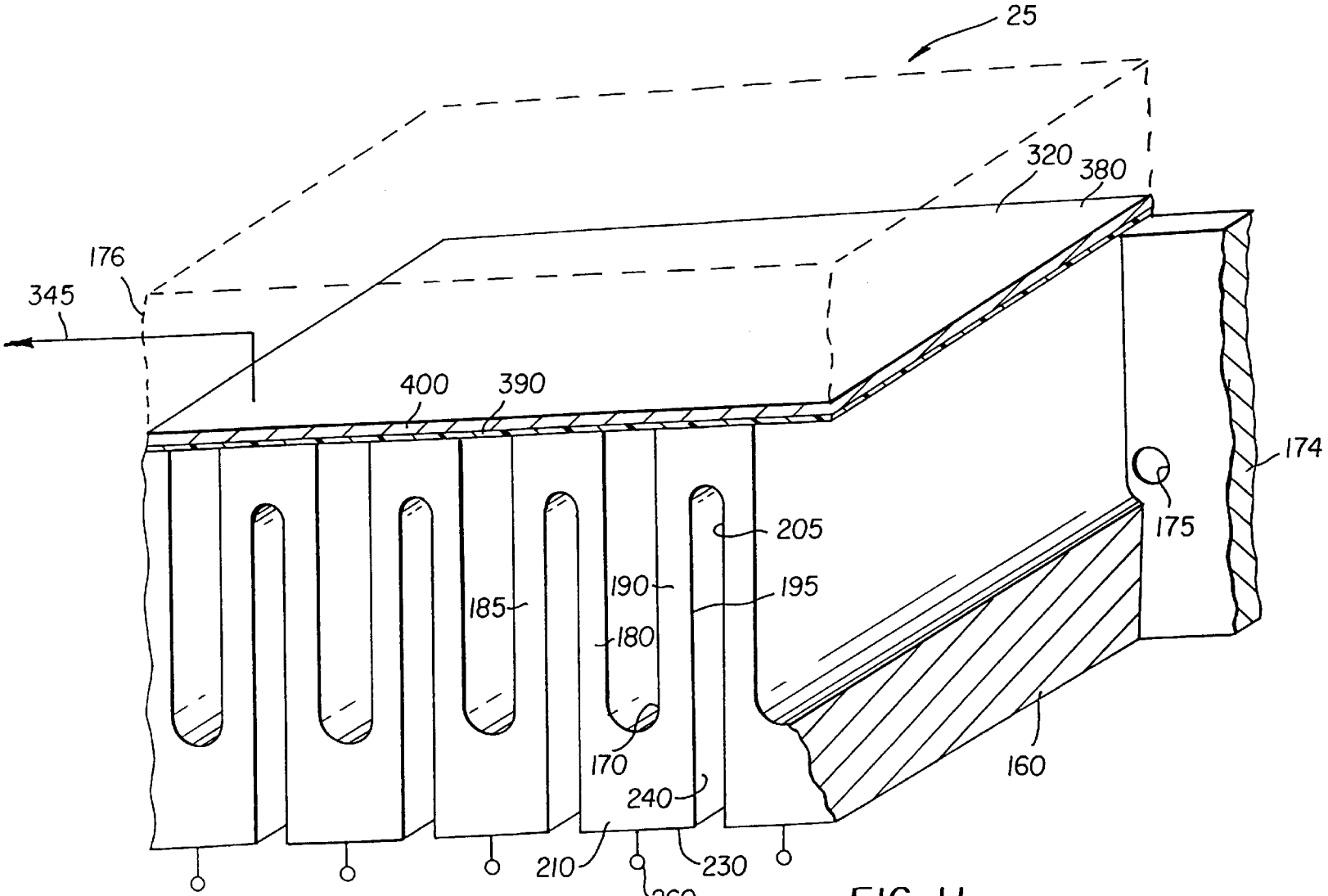
FIG. 11 is a fragmentation view in perspective of the print head, the view also showing a second embodiment pressure sensor in communication with the ink chambers.
Figure 12:
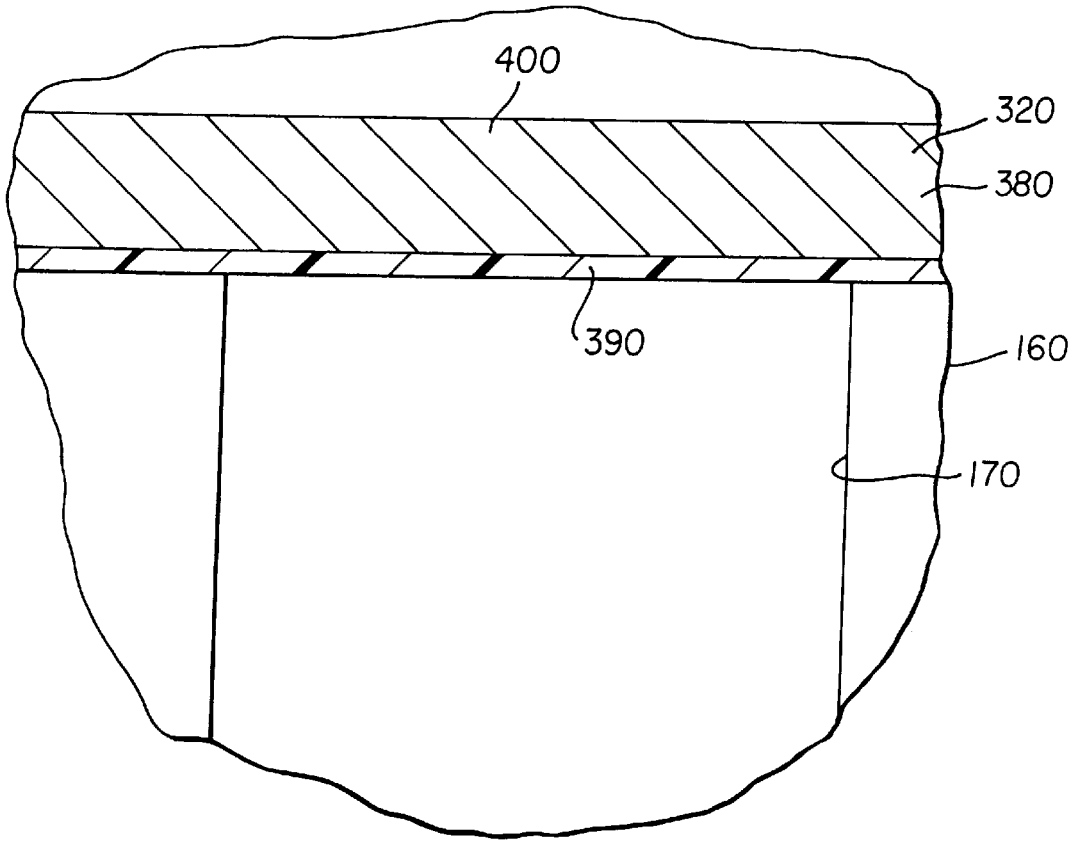
FIG. 12 is an enlarged fragmentation view in elevation of the print head and second embodiment pressure sensor.

As best seen in FIGS. 11 and 12, a second embodiment sensor 320 is there shown comprising a layered wafer 380. Layered wafer 380 includes a flexible substrate 390 to which a piezoelectric layer 400 is attached. Layer 400 serves the same function as wafer 325. An advantage of this second embodiment of the invention is that the piezoelectric material need not be in direct contact with ink in chamber 170, thus making chamber 170 easier to passivate against various ink types.

Figure 13:
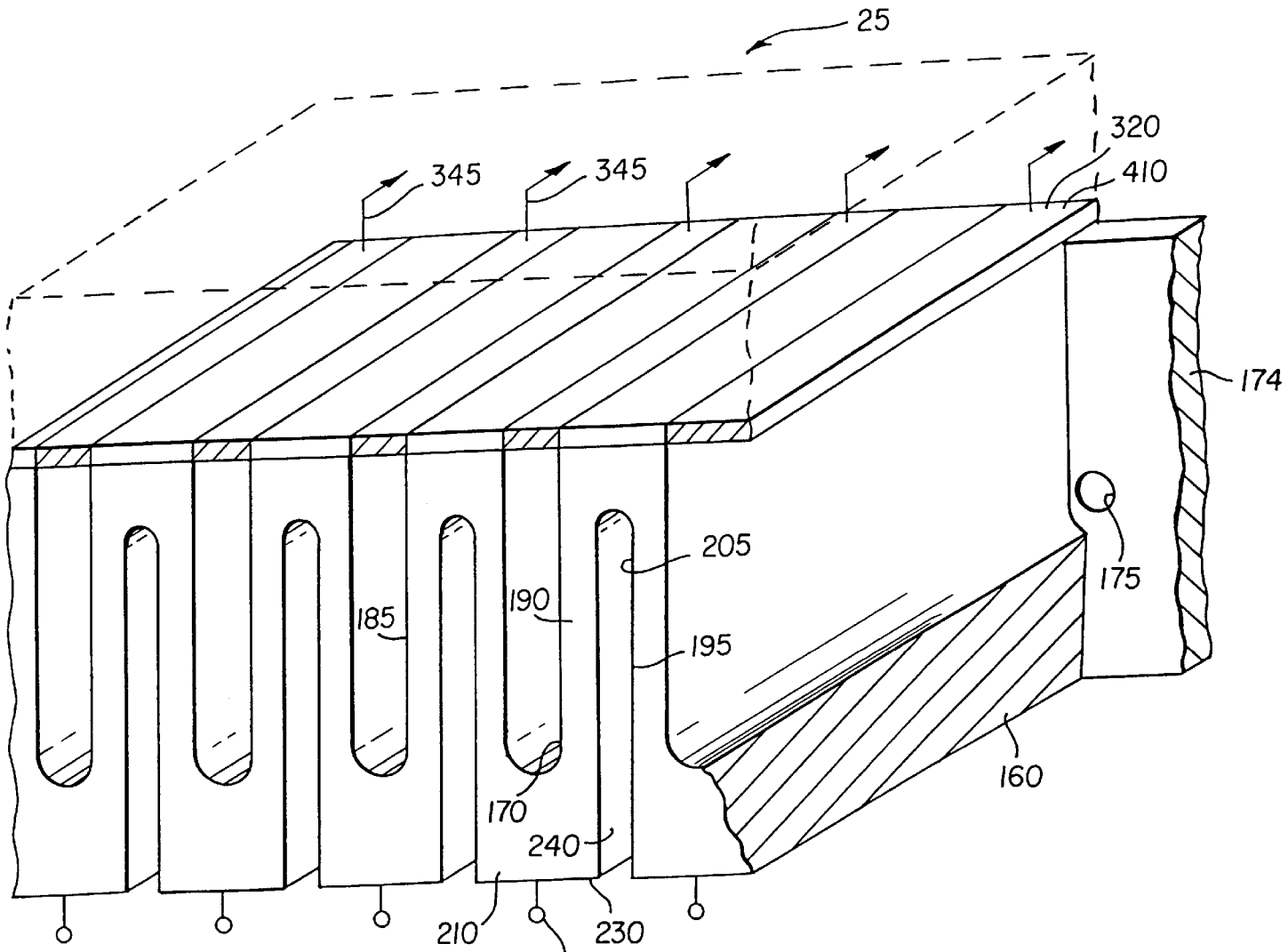
FIG. 13 is a fragmentation view in perspective of the print head, this view showing a third embodiment pressure sensor in communication with the ink chambers.

FIG. 13 shows a third embodiment sensor 320, wherein there are a plurality of piezoelectric sensor strips 410 in fluid communication with respective ones of ink bodies 200. In this regard, each sensor strip 410 extends along its respective open side 173 of chamber 170, such that sensor strip 410 caps chamber 170. An advantage of this third embodiment of the invention is that pressure changes in each chamber 170 is sensed by corresponding sensor strips 410. Moreover, third voltage $V_3$ can now be applied to sidewalls 180/190 defining individual chambers 170 for damping reflected portion 310 in individual chambers 170. This is a useful feature of the invention because pressure amplitude $P_r$ of reflected portion 310 may itself be different in different chambers 170. Thus, the invention accommodates variability in pressure $P_r$ among individual chambers 170.

Figure 14:
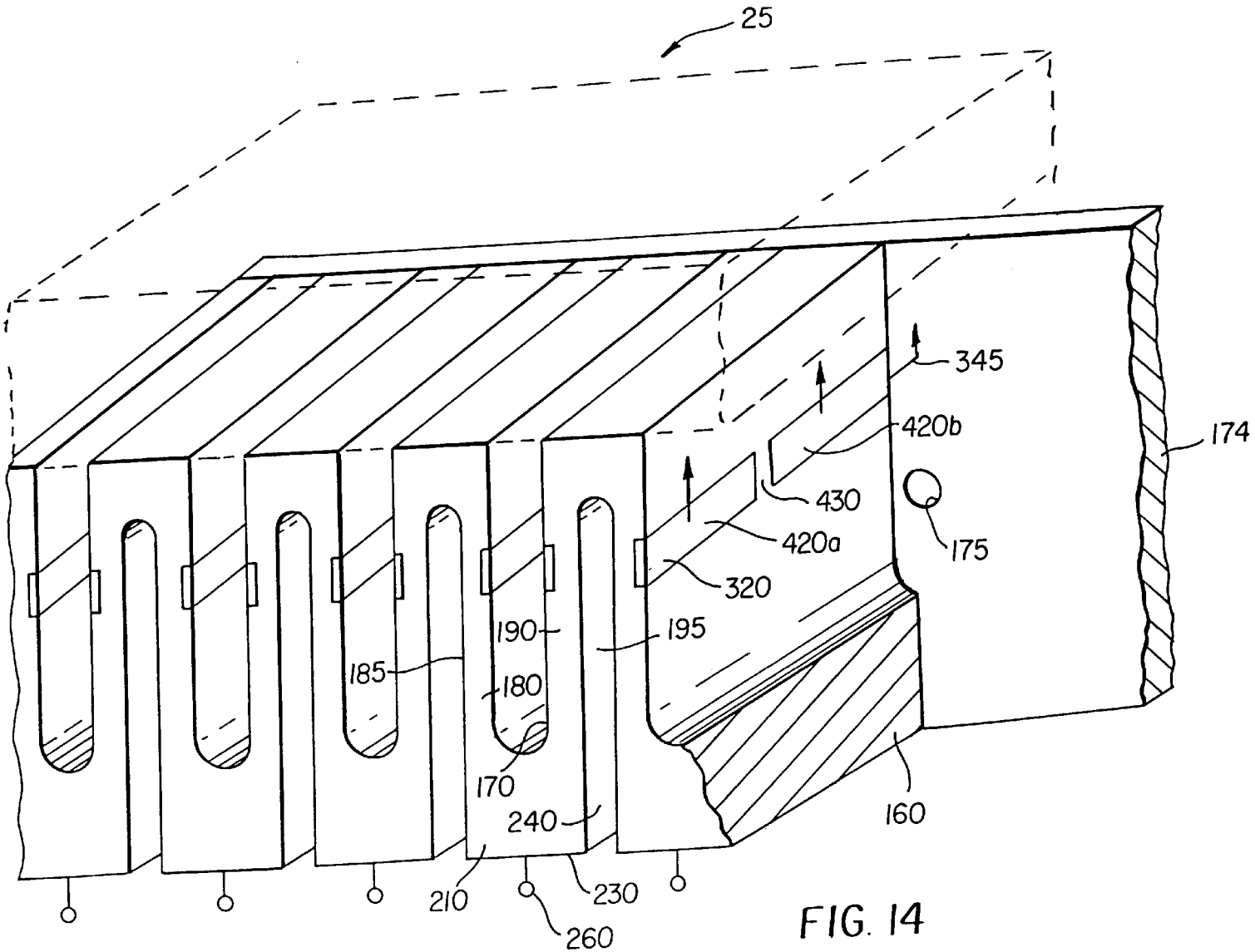
FIG. 14 is a fragmentation view in perspective of the print head, this view showing a fourth embodiment pressure sensor in communication with the ink chambers.

FIG. 14 shows a fourth embodiment sensor 320. In this fourth embodiment, a plurality of elongate piezoelectric sensor segments 420*a* and 420*b* line each chamber 170 and are in fluid communication with ink bodies 200. Sensor segments 420*a*/*b* extend longitudinally along outside surface 185 of first sidewall 180 and outside surface 195 of second sidewall 190. Adjacent sensor segments 420*a* and 420*b* may be colinearly aligned (as shown) and separated by a gap 430. An advantage of this configuration of the invention is that pressure of reflected portion 310 of first pressure wave 300 as a function of time is obtainable as reflected portion 310 propagates in chamber 170.

Figure 15:
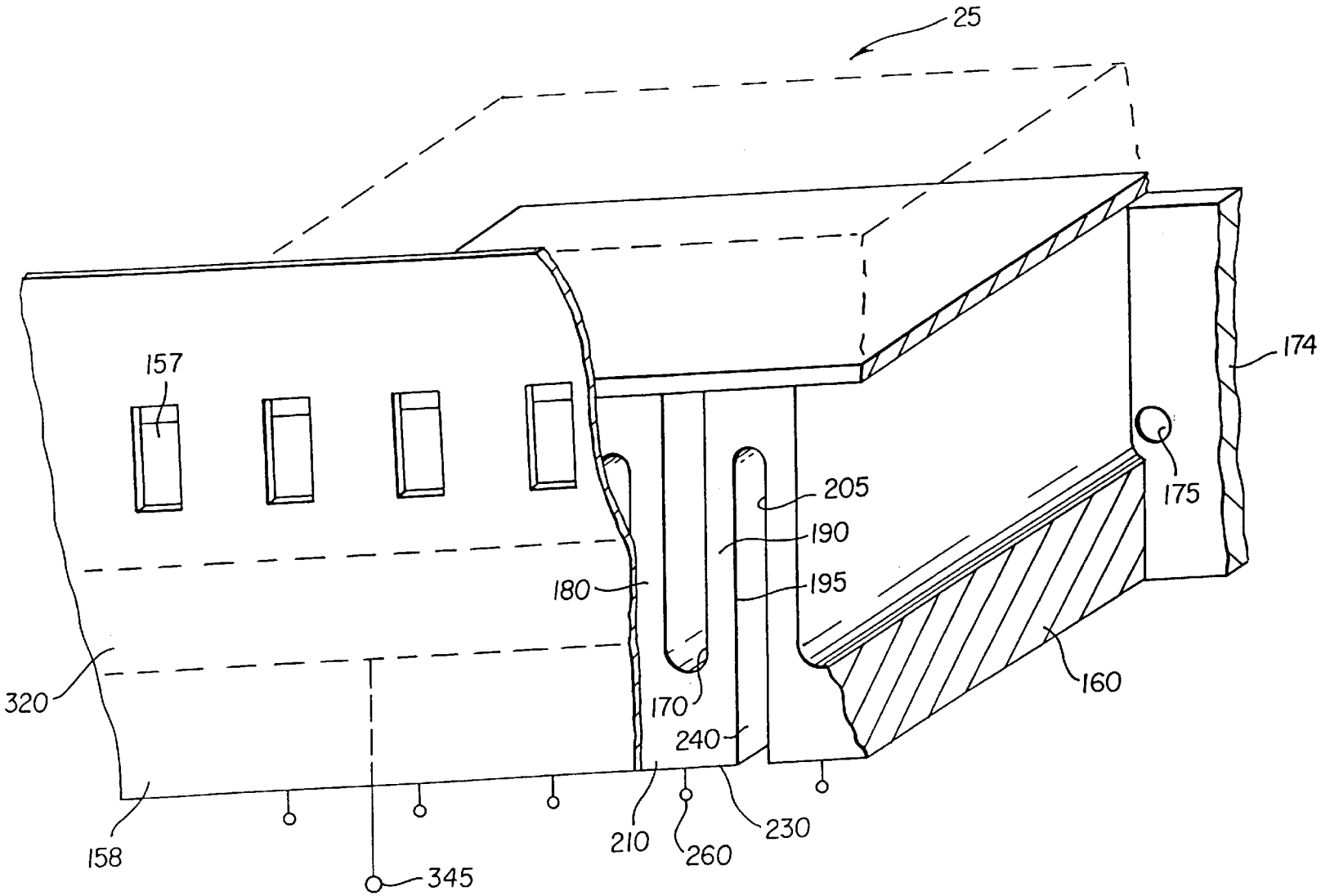
FIG. 15 is a fragmentation view in perspective of the print head, this view showing a fifth embodiment pressure sensor in communication with the ink chambers.

Referring to FIG. 15, there is shown a fifth embodiment sensor 320. Fifth embodiment sensor 320 is attached directly to ink manifold gasket 158 that is attached directly to the rear of chambers 170. Sensor 320 spans all chambers 170 of printhead 25. The advantage of fifth embodiment sensor 320 is that sensor 320 is directly attached to the back of the chamber, and therefore detects both the amplitude of the pressure wave 300 as well as the pressure as a function of time.

Figure 16:
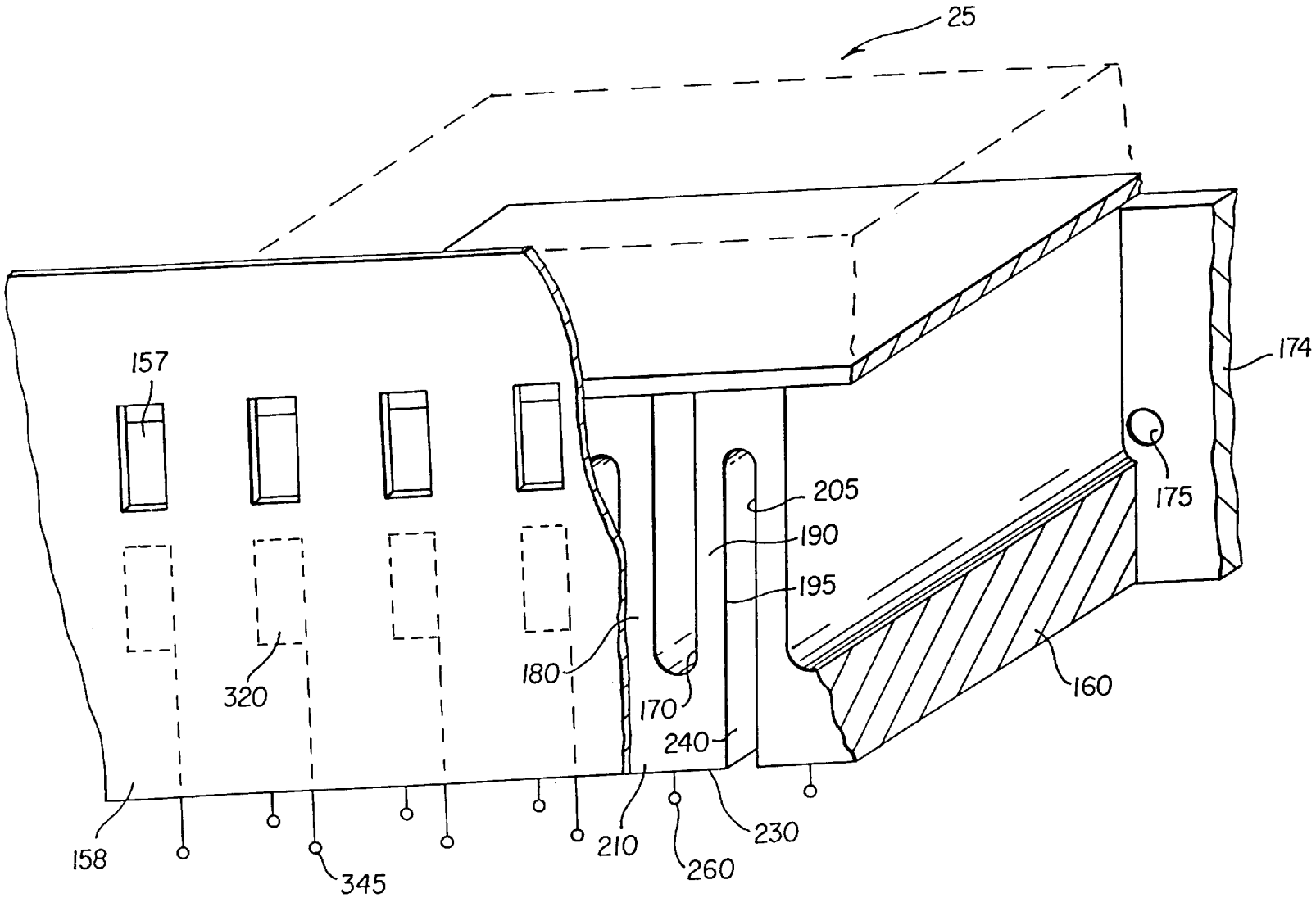
FIG. 16 is a fragmentation view in perspective of the print head, this view showing a sixth embodiment pressure sensor in communication with the ink chambers.

FIG. 16 shows a sixth embodiment sensor 320, wherein there are a plurality of piezoelectric sensors in fluid communications with respective ink bodies 200. An advantage of this sixth embodiment sensor 320 is that pressure changes in each chamber 170 are sensed by respective sensors 320. This is a useful feature of the invention because pressure amplitude $P_r$ of reflected portion 310 may itself be different in different chambers 170. Thus, the invention accommodates variability in pressure $P_r$ among individual chambers 170.

Figure 17:
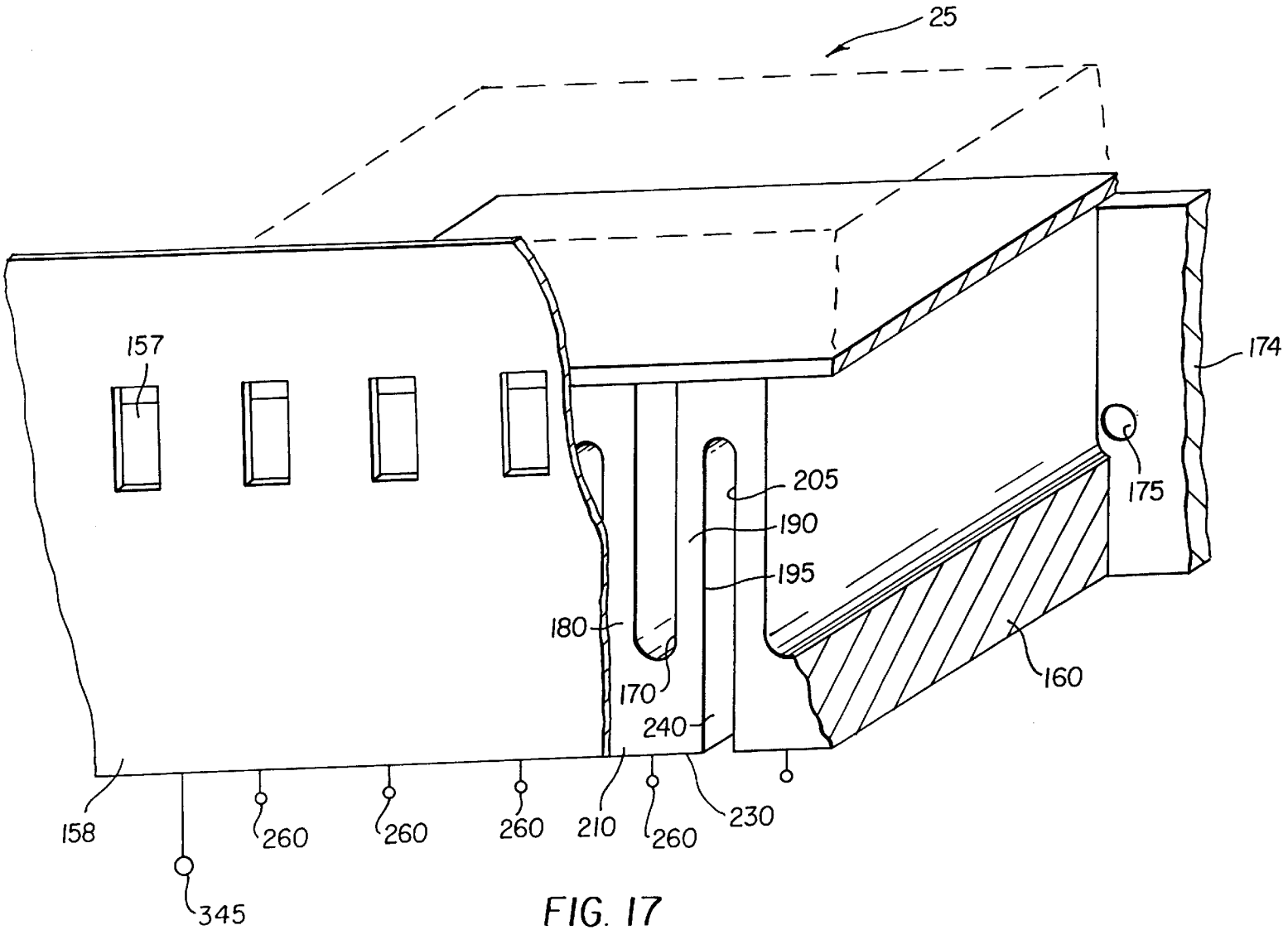
FIG. 17 is a fragmentation view in perspective of the print head, this view showing a seventh embodiment pressure sensor in communication with the ink chambers.

FIG. 17 shows a seventh embodiment sensor 320, wherein sensor 320 and ink manifold gasket 158 are one in the same. That is to say, ink manifold gasket 158 is normally made from materials that possess desired physical, chemical, and electrical properties required to seal transducer 160 to ink reservoir 140. Such a material with these properties may, for example, be a polyimide film. A suitable polyimide film may be "KAPTON", a registered trademark of E.I. du Pont de Nemours and Company located in Wilmington, Del. In this embodiment of the invention, ink manifold gasket 158 may alternatively be a material that possesses the properties previously described, as well as the properties appropriate for a pressure sensitive material. A type of material that is suitable for this application is poly-vinylideneflouride (PVDF) poled to exhibit piezoelectric properties. "KYNAR" film, a trademarked name of Elf Atochem North America, Inc., located in Philadelphia, Pa. is an example of a poled PVDF material. A suitable transducer, which can be further configured to the physical shape of the gasket, can be purchased from AMP Corporation, located in Harrisburg, Pa. An advantage of this seventh embodiment of the invention is that the ink manifold gasket 158 and the ink chamber pressure sensors 320 are manufactured from the same material and are one in the same.

It is understood from the description hereinabove that an advantage of the present invention is that satellite ink droplet formation is suppressed. This is so because second pressure wave 360 damps reflected portion 310 of first pressure wave 300, which reflected portion 310 might otherwise cause ejection of satellite droplets 22.

It is also understood from the description hereinabove that another advantage of the present invention is that printing speed is maintained as satellite droplet formation is suppressed. This is so because imaging apparatus 10 need not wait for reflected portion 310 to die-out before ejecting a subsequent ink droplet 20. That is, second pressure wave 360 effectively damps reflected portion 310, so that reflected portion 310 dies-out sooner.

The invention has been described in detail with particular reference to certain preferred embodiments thereof, but it will be understood that variations and modifications can be effected within the spirit and scope of the invention. For example, first voltage waveform 290, second voltage waveform 330, and third voltage waveform 350 are shown as sinusoidal. However, waveforms 290/330/350 may take any one of various shapes, such as triangular or square-shape. As another example, piezoelectric transducer 160 may be used both to induce first pressure wave 300 and to sense reflected portion 310. In this latter example, there is no need for a separate pressure sensor 320 to sense reflected portion 310.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is an imaging apparatus capable of suppressing inadvertent ejection of a satellite ink droplet therefrom while maintaining printing speed, and method of assembling the apparatus.

Parts List

G . . . gain of amplifier
$P_1$ . . . amplitude of first pressure wave
$P_2$ . . . amplitude of second pressure wave
$P_r$ . . . amplitude of reflected portion of first pressure wave
$V_{sense}$ . . . voltage amplitude produced by the sensor du to presence of second voltage waveform
$V_1$ . . . amplitude of first voltage waveform
$V_2$ . . . amplitude of second voltage waveform
$V_3$ . . . amplitude of third voltage waveform
$\Delta t_{V1}$ . . . time duration of first voltage waveform
$\Delta t_{V2}$ . . . time duration of second voltage waveform
$\Delta t_{V3}$ . . . time duration of third voltage waveform
$\Delta t_{P1}$ . . . time duration of first pressure pulse
$\Delta t_{P2}$ . . . time duration of second pressure pulse
$\Delta t_R$ . . . time duration between successive actuations
10 . . . imaging apparatus
20 . . . ink droplet
22 . . . satellite ink droplet
25 . . . print head
30 . . . receiver
40 . . . image source
50 . . . image processor
60 . . . halftoning unit
70 . . . image memory
80 . . . waveform generator
85 . . . amplifier
90 . . . transport mechanism
100 . . . rollers
110 . . . transport control system

120 . . . controller
130 . . . ink pressure regulator
140 . . . ink reservoir
150 . . . conduit
155 . . . manifold
157 . . . ink inlet opening
158 . . . ink manifold gasket
160 . . . transducer
170 . . . ink chambers
171 . . . chamber outlet
172 . . . end of chamber
173 . . . open side of chamber
174 . . . nozzle plate
175 . . . orifices
176 . . . top cover plate
180 . . . first side wall
185 . . . outside surface of first side wall
190 . . . second side wall
195 . . . outside surface of second side wall
200 . . . ink body
205 . . . cut-out
210 . . . base portion
220 . . . top surface
230 . . . bottom surface
240 . . . addressable electrode layer
260 . . . electrical conducting terminal
270 . . . common electrode layer
280 . . . electrical ground
285 . . . image
290 . . . first voltage waveform
300 . . . first pressure wave
310 . . . reflected portion of first pressure wave
315 . . . point where reflected portion dies-out
320 . . . pressure sensor
325 . . . sensor wafer
330 . . . second voltage waveform
340 . . . feedback circuit
345 . . . pressure sensor electrical connection
350 . . . third voltage waveform
360 . . . second pressure wave
365 . . . feed-back loop
370 . . . switch
380 . . . layered sensor wafer
390 . . . substrate
400 . . . piezoelectric layer
410 . . . piezoelectric sensor strips
420*a/b* . . . piezoelectric sensor segments
430 . . . gap

What is claimed is:

1. An imaging apparatus, comprising:

(a) a transducer defining a chamber therein, said transducer capable of inducing a first pressure wave in the chamber, the first pressure wave having a reflected portion;

(b) a waveform generator connected to said transducer for supplying a first voltage waveform to said transducer, so that said transducer induces the first pressure wave in the chamber;

(c) a deflectable sensor coupled to the chamber for sensing the reflected portion and connected to said transducer for actuating said transducer and generating a second voltage waveform in response to the reflected portion sensed thereby;

(d) a feedback circuit connected to said sensor for receiving the second voltage waveform generated by said sensor and for converting the second voltage waveform to a third voltage waveform, said feedback circuit connected to said transducer for supplying the third voltage waveform to said transducer, so that said transducer controllably actuates in response to the third voltage waveform supplied thereto for inducing a second pressure wave in the fluid body in response to deflection of said sensor, in order to suppress the reflected portion; and (e) a switch capable of switching between a first operating mode and a second operating mode, said switch connecting said waveform generator to said transducer while switched to the first operating mode and connecting said sensor and said feedback circuit to said transducer while switched to the second operating mode.

2. An imaging apparatus, comprising:

(a) a transducer defining a chamber therein and capable of inducing a first pressure wave in the chamber, the first pressure wave having an oscillating reflected portion;

(b) a waveform generator connected to said transducer for supplying a first output signal to said transducer, so that said transducer induces the first pressure wave in the chamber;

(c) a deflectable sensor coupled to the chamber for sensing the oscillating reflected portion, said sensor capable of deflecting as said sensor senses the oscillating reflected portion and capable of generating a second output signal in response to the deflection, the second output signal being convertible to a third output signal;

(d) a feedback circuit connected to said sensor for receiving the second output signal generated by said sensor and for converting the second output signal to a third output signal, said feedback circuit connected to said transducer for supplying the third output signal to said transducer, so that said transducer controllably actuates in response to the third output signal supplied thereto for inducing a second pressure wave in the chamber in response to deflection of said sensor, in order to suppress the oscillating reflected portion; and (e) a switch capable of switching between a first operating mode and a second operating mode, said switch connecting said waveform generator to said transducer while switched to the first operating mode and connecting said sensor and said feedback circuit to said transducer while switched to the second operating mode, so that said waveform generator supplies the first output signal to said transducer while said switch is switched to the first operating mode and so that said sensor senses the oscillating reflected portion while said switch is switched to the second operating mode.

3. The apparatus of claim 2, further comprising a feedback circuit interconnecting said sensor and said transducer to control the second output signal transmitted to said transducer in order to controllably actuate said transducer in response to deflection of said sensor.

4. An imaging apparatus capable of suppressing inadvertent ejection of a satellite droplet from any of a plurality of fluid bodies residing in the imaging apparatus, comprising:

(a) a transducer defining a plurality of chambers for receiving respective ones of the fluid bodies therein, said transducer capable of inducing a first pressure wave in any of the fluid bodies, the first pressure wave having an oscillating reflected portion of a first amplitude and a first phase sufficient to inadvertently eject the satellite droplet;

(b) a waveform generator connected to said transducer for supplying a first voltage waveform to said transducer, so that said transducer induces the first pressure wave in the fluid body;

(c) a deflectable sensor in fluid communication with any of the fluid bodies for sensing the oscillating reflected portion, said sensor capable of deflecting as said sensor senses the oscillating reflected portion and capable of generating a second voltage waveform in response to the oscillating reflected portion sensed thereby;

(d) a feedback circuit connected to said sensor for receiving the second voltage waveform generated by said sensor and for converting the second voltage waveform to a third voltage waveform, said sensor and said feedback circuit defining a feed-back loop, said feedback circuit connected to said transducer for supplying the third voltage waveform to said transducer, so that said transducer controllably actuates in response to the third voltage waveform supplied thereto for inducing a second pressure wave in the fluid body in response to deflection of said sensor, the second pressure wave having a second amplitude and a second phase damping the first amplitude and first phase of the oscillating reflected portion of the first pressure wave in order to suppress inadvertent ejection of the satellite droplet; and (e) a switch capable of switching between a first operating mode and a second operating mode, said switch connecting said waveform generator to said transducer while switched to the first operating mode and connecting said feedback loop to said transducer while switched to the second operating mode.

5. The apparatus of claim 4, wherein said sensor is a one-piece sensor wafer spanning all the chambers.

6. The apparatus of claim 5, wherein said wafer is a layered sensor wafer spanning all the chambers.

7. The apparatus of claim 6, wherein said layered sensor wafer comprises:

(a) a substrate; and (b) a deflectable layer formed on said substrate, said deflectable layer capable of sensing the oscillating reflected portion of the first pressure wave and deflecting as said deflectable layer senses the oscillating reflected portion.

8. The apparatus of claim 4, wherein said sensor comprises a plurality of sensor strips in fluid communication with respective ones of the chambers.

9. The apparatus of claim 4, wherein said sensor comprises a plurality of sensor segments extending longitudinally in respective ones of the chambers, adjacent segments being separated by a gap.

10. The apparatus of claim 4, wherein said transducer is formed of a piezoelectric material responsive to the first and third voltage waveforms.

11. The apparatus of claim 4, wherein said sensor is formed of a piezoelectric material responsive to the oscillating reflected portion of the first pressure wave.

12. A print head, comprising:

(a) a transducer for inducing a first pressure wave in a chamber defined therein, the first pressure wave having a reflected portion;

(b) a waveform generator connected to said transducer for supplying a first voltage waveform to said transducer, so that said transducer induces the first pressure wave in the chamber;

(c) a deflectable sensor coupled to the chamber for sensing the reflected portion and connected to said transducer for actuating said transducer and generating a second voltage waveform in response to the reflected portion sensed thereby, so that said transducer actuates to induce a second pressure wave in the chamber damping the reflected portion; and (d) a feedback circuit connected to said sensor for receiving the second voltage waveform generated by said sensor and for converting the second voltage waveform to a third voltage waveform, said feedback circuit connected to said transducer for supplying the third voltage waveform to said transducer, so said transducer controllably actuates in response to the third voltage waveform supplied thereto for inducing a second pressure wave in the chamber in response to deflection of said sensor, in order to suppress the reflected portion; and (e) a switch capable of switching between a first operating mode and a second operating mode, said switch connecting said waveform generator to said transducer while switched to the first operating mode and connecting said sensor and said feedback circuit to said transducer while switched to the second operating mode.

13. A print head, comprising:

(a) a transducer for inducing a first pressure wave in a chamber defined therein, the first pressure wave having an oscillating reflected portion;

(b) a waveform generator connected to said transducer for supplying a generator signal to said transducer, so that said transducer induces the first pressure wave in the chamber;

(c) a deflectable sensor coupled to the chamber for sensing the oscillating reflected portion, said sensor capable of deflecting as said sensor senses the oscillating reflected portion and capable of generating a sensor output signal in response to the deflection, said sensor connected through a feedback circuit to said transducer for transmitting a calculated signal to said transducer to actuate said transducer, the calculated signal being derived from the sensor output signal, so that said transducer actuates to induce a second pressure wave in the chamber damping the oscillating reflected portion of the first pressure wave; and (d) a switch capable of switching between a first operating mode and a second operating mode, said switch connecting said waveform generator to said transducer while switched to the first operating mode and connecting said sensor and the feedback circuit to said transducer while switched to the second operating mode, so that said waveform generator supplies the generator signal to said transducer while said switch is switched to the first operating mode and so that said sensor senses the oscillating reflected portion while said switch is switched to the second operating mode.

14. A print head capable of suppressing inadvertent ejection of a satellite droplet from any of a plurality of fluid bodies residing in the print head, comprising:

(a) a waveform generator for supplying a first voltage waveform;

(b) a transducer coupled to said waveform generator for receiving the first voltage waveform, said transducer defining a plurality of chambers therein for receiving respective ones of the fluid bodies, said transducer in fluid communication with the fluid bodies for inducing a first pressure wave in any of the fluid bodies in response to the first voltage waveform supplied to said transducer, the first pressure wave having a reflected portion of a first amplitude and a first phase sufficient to inadvertently eject the satellite droplet;

(c) a deflectable sensor in fluid communication with any of the fluid bodies for sensing the oscillating reflected portion, said sensor capable of deflecting as said sensor senses the oscillating reflected portion and capable of generating a second voltage waveform in response to deflection, the second voltage waveform being convertible to a third voltage waveform to be supplied to said transducer for actuating said transducer, so that said transducer actuates in response to the third voltage waveform for inducing a second pressure wave in the fluid body; and (d) a feedback circuit connected to said sensor for receiving the second voltage waveform generated by said sensor and for converting the second voltage waveform to a third voltage waveform, said feedback circuit connected to said transducer for supplying the third voltage waveform to said transducer, so that said transducer controllably actuates in response to the third voltage waveform supplied thereto for inducing a second pressure wave in the fluid body in response to deflection of said sensor, the second pressure wave having a second amplitude and a second phase damping the first amplitude and first phase of the reflected portion of the first pressure wave in order to suppress inadvertent ejection of the satellite droplet; and (e) a switch capable of switching between a first operating mode and a second operating mode, said switch connecting said waveform generator to said transducer while switched to the first operating mode and connecting said sensor and said feedback circuit to said transducer while switched to the second operating mode.

15. The print head of claim 14, wherein said sensor is a one-piece sensor wafer spanning all the chambers.

16. The printhead of claim 15, wherein said wafer is a layered sensor wafer spanning all the chambers.

17. The printhead of claim 16, wherein said layered sensor wafer comprises:

(a) a substrate; and (b) a deflectable layer adhered to said substrate, said deflectable layer capable of sensing the oscillating reflected portion of the first pressure wave and deflecting as said deflectable layer senses the oscillating reflected portion.

18. The printhead of claim 14, wherein said sensor comprises a plurality of sensor strips in fluid communication with respective ones of the chambers.

19. The printhead of claim 14, wherein said sensor comprises a plurality of sensor segments extending longitudinally in respective ones of the chambers, adjacent segments being separated by a gap.

20. The print head of claim 14, wherein said transducer is formed of piezoelectric material responsive to the first and third voltage waveforms.

21. The print head of claim 14, wherein said sensor is formed of piezoelectric material responsive to the reflected portion of the first pressure wave.

22. A method of assembling an imaging apparatus, comprising the steps of:

(a) providing a transducer defining a chamber therein, the transducer capable of inducing a first pressure wave in the chamber, the first pressure wave having a reflected portion;

(b) connecting a waveform generator to the transducer for supplying a waveform to the transducer, so that the transducer induces the first pressure wave in the chamber;

(c) coupling a deflectable sensor to the chamber for sensing the reflected portion, the sensor capable of deflecting and generating a sensor output signal in response to the deflection as the sensor senses the reflected portion;

(d) interconnecting the sensor and the transducer through a feedback circuit for actuating the transducer in response to the deflection, the feedback circuit capable of transmitting a calculated signal to the transducer to actuate the transducer, the calculated signal being derived from the sensor output signal; and (e) providing a switch capable of switching between a first operating mode and a second operating mode, the switch connecting the waveform generator to the transducer while switched to the first operating mode and connecting the sensor and the feedback circuit to the transducer while switched to the second operating mode, so that the waveform generator supplies the waveform to the transducer while the switch is switched to the first operating mode and so that the sensor senses the reflected portion while the switch is switched to the second operating mode.

23. A method of assembling an imaging apparatus, comprising the steps of:

(a) providing a transducer defining a chamber therein, the transducer capable of inducing a first pressure wave in the chamber, the first pressure wave having an oscillating reflected portion;

(b) connecting a waveform generator to the transducer for supplying a waveform to the transducer, so that the transducer induces the first pressure wave in the chamber;

(c) coupling a deflectable sensor to the chamber for sensing the oscillating reflected portion, the sensor capable of deflecting as the sensor senses the oscillating reflected portion and capable of generating a sensor output signal in response to the deflection;

(d) interconnecting the sensor and the transducer for transmitting the sensor output signal to the transducer for actuating the transducer in response to the deflection, so that the transducer actuates to induce a second pressure wave in the chamber damping the oscillating reflected portion of the first pressure wave;

(e) interconnecting the sensor and the transducer by means of a feedback circuit to control the sensor output signal transmitted to the transducer in order to controllably actuate the transducer in response to deflection of the sensor; and (f) providing a switch capable of switching between a first operating mode and a second operating mode, the switch connecting the waveform generator to the transducer while switched to the first operating mode and connecting the sensor and the feedback circuit to the transducer while switched to the second operating mode, so that the waveform generator supplies the waveform to the transducer while the switch is switched to the first operating mode and so that the sensor senses the reflected portion while the switch is switched to the second operating mode.

24. A method of assembling an imaging apparatus capable of suppressing inadvertent ejection of a satellite droplet from any of a plurality of fluid bodies residing in the imaging apparatus, comprising the steps of:

(a) providing a transducer defining a plurality of chambers for receiving respective ones of the fluid bodies therein, the transducer capable of inducing a first pressure wave in any of the fluid bodies, the first pressure wave having an oscillating reflected portion of a first amplitude and a first phase sufficient to inadvertently eject the satellite droplet;

(b) connecting a waveform generator to the transducer for supplying a first voltage waveform to the transducer, so that the transducer induces the first pressure wave in the fluid body;

(c) disposing a deflectable sensor to be in fluid communication with any of the fluid bodies for sensing the oscillating reflected portion, the sensor capable of deflecting as the sensor senses the oscillating reflected portion and capable of generating a second voltage waveform in response to the deflection;

(d) connecting a feedback circuit to the sensor for receiving the second voltage waveform generated by the sensor and for converting the second voltage waveform to a third voltage waveform, the sensor and the feedback circuit defining a feed-back loop;

(e) connecting the feedback circuit to a transducer for supplying the third voltage waveform to the transducer, so that the transducer actuates in response to the third voltage waveform supplied thereto for inducing a second pressure wave in the fluid body in response to deflection of the sensor, the second pressure wave having a second amplitude and a second phase damping the first amplitude and first phase of the oscillating reflected portion of the first pressure wave in order to the suppress inadvertent ejection of the satellite droplet; and (f) providing a switch capable of switching between a first operating mode and a second operating mode, said switch connecting said waveform generator to said transducer while switched to the first operating mode and connecting said feedback loop to said transducer while switched to the second operating mode.

25. The method of claim 24, wherein the step of disposing a deflectable sensor comprises the step disposing a one-piece sensor wafer capable of spanning all the chambers.

26. The method of claim 25, wherein the step of disposing a one-piece sensor wafer comprises the step of disposing a layered sensor wafer spanning all the chambers.

27. The method of claim 26, wherein the step of disposing a layered sensor wafer comprise the steps of:

(a) providing a substrate; and (b) forming a deflectable layer on the substrate, the deflectable layer capable of sensing the oscillating reflected portion of the first pressure wave and deflecting as the deflectable layer senses the reflected portion.

28. The method of claim 24, wherein the step of disposing a deflectable sensor comprises the step of disposing a plurality of sensor strips in fluid communication with respective ones of the chambers.

29. The method of claim 24, wherein the step of disposing a deflectable sensor comprises the step of disposing a plurality of sensor segments extending longitudinally in respective ones of the chambers, adjacent segments being separated by a gap.

30. The method of claim 24, wherein the step of disposing a transducer comprises the step of disposing a transducer formed of a piezoelectric material responsive to the first and third voltage waveforms.

31. The method of claim 24, wherein the step of disposing a sensor comprises the step of disposing a sensor formed of a piezoelectric material responsive to the oscillating reflected portion of the first pressure wave.

32. A method of assembling a print head, comprising the steps of:

(a) providing a transducer for inducing a first pressure wave in a chamber defined therein, the first pressure wave having a reflected portion;

(b) connecting a waveform generator to the transducer for supplying a first voltage waveform to the transducer, so that the transducer induces the first pressure wave in the chamber;

(c) coupling a deflectable sensor to the chamber for sensing the reflected portion and generating a second voltage waveform in response to the reflected portion sensed thereby;

(c) connecting the sensor to the transducer for actuating the transducer in response to the reflected portion sensed thereby;

(d) connecting a feedback circuit to the sensor for receiving the second voltage waveform generated by the sensor and for converting the second voltage waveform to a third voltage waveform, the feedback circuit connected to the transducer for supplying the third voltage waveform to the transducer, so that the transducer controllably actuates in response to the third voltage waveform supplied thereto for inducing a second pressure wave in the fluid body in response to deflection of the sensor, in order to suppress the reflected portion; and (e) providing a switch capable of switching between a first operating mode and a second operating mode, the switch connecting the waveform generator to the transducer while switched to the first operating mode and connecting the sensor and the feedback circuit to the transducer while switched to the second operating mode.

33. A method of assembling a print head, comprising the steps of:

(a) providing a transducer defining a chamber therein, the transducer capable of inducing a first pressure wave in the chamber, the first pressure wave having an oscillating reflected portion;

(b) connecting a waveform generator to the transducer for supplying a generator signal to the transducer, so that the transducer induces the first pressure wave in the chamber;

(c) coupling a deflectable sensor to the chamber for sensing the reflected portion, the sensor capable of deflecting as the sensor senses the portion and capable of generating a sensor output signal in response to the deflection;

(d) connecting the sensor through a feedback circuit to the transducer for converting the sensor output signal to a calculated signal and thereafter transmitting the calculated signal to the transducer for actuating the transducer; and (e) providing a switch capable of switching between a first operating mode and a second operating mode, the switch connecting the waveform generator to the transducer while switched to the first operating mode and connecting the sensor and the feedback circuit to the transducer while switched to the second operating mode, so that the waveform generator supplies the generator signal to the transducer while the switch is switched to the first operating mode and so that the sensor senses the reflected portion while the switch is switched to the second operating mode.

34. A method of assembling a print head capable of suppressing inadvertent ejection of a satellite droplet from any of a plurality of fluid bodies residing in the print head, comprising the steps of:

(a) providing a waveform generator for supplying a first voltage waveform;

(b) providing a transducer coupled to said waveform generator for receiving the first voltage waveform, said transducer defining a plurality of chambers therein for receiving respective ones of the fluid bodies, the transducer capable of inducing a first pressure wave in any of the fluid bodies in response to the first voltage waveform supplied to the transducer, the first pressure wave having a reflected portion of a first amplitude and a first phase sufficient to inadvertently eject the satellite droplet; and (c) disposing a deflectable sensor to be in fluid communication with any of the fluid bodies for sensing the oscillating reflected portion, the sensor capable of deflecting as the sensor senses the oscillating reflected portion and capable of generating a second voltage waveform in response to deflection, the second voltage waveform being convertible into a third voltage waveform to be supplied to the transducer for actuating the transducer, so that the transducer actuates in response to the third voltage waveform for inducing a second pressure wave in the fluid body; and (d) connecting a feedback circuit to the sensor for receiving the second voltage waveform generated by the sensor and for converting the second voltage waveform to a third voltage waveform, the feedback circuit connected to the transducer for supplying the third voltage waveform to the transducer, so that the transducer controllably actuates in response to the third voltage waveform supplied thereto for inducing a second pressure wave in the fluid body in response to deflection of said sensor, the second pressure wave having a second amplitude and a second phase damping the first amplitude and first phase of the reflected portion of the first pressure wave in order to suppress inadvertent ejection of the satellite droplet; and (e) providing a switch capable of switching between a first operating mode and a second operating mode, the switch connecting the waveform generator to the transducer while switched to the first operating mode and connecting said sensor and the feedback circuit to the transducer while switched to the second operating mode.

35. The method of claim 34, wherein the step of disposing a sensor comprises the step of disposing a one-piece sensor wafer spanning all the chambers.

36. The method of claim 35, wherein the step of disposing a wafer comprises the step of disposing a layered sensor wafer spanning all the chambers.

37. The method of claim 36, wherein the step of disposing a layered sensor wafer comprises the steps of:

(a) providing a substrate; and (b) adhering a deflectable layer to the substrate, the deflectable layer capable of sensing the oscillating reflected portion of the first pressure wave and deflecting as the deflectable layer senses the oscillating reflected portion.

38. The method of claim 34, wherein the step of disposing a sensor comprises the step of disposing a plurality of sensor strips in fluid communication with respective ones of the chambers.

39. The method of claim 34, wherein the step of disposing a sensor comprises the step of disposing a plurality of sensor segments extending longitudinally in respective ones of the chambers, adjacent segments being separated by a gap.

40. The method of claim 34, wherein the step of providing a transducer comprises the step of providing a transducer formed of a piezoelectric material responsive to the first and third voltage waveforms.

41. The method of claim 34, wherein the step of disposing a sensor comprises the step of disposing a sensor formed of a piezoelectric material responsive to the oscillating reflected portion of the first pressure wave.

* * * * *